US009856112B1

(12) United States Patent
Cirone

(10) Patent No.: US 9,856,112 B1
(45) Date of Patent: Jan. 2, 2018

(54) FALL ARRESTING SYSTEM FOR VERTICALLY ORIENTED BELT DRIVEN LINEAR ACTUATORS

(76) Inventor: Anthony J. Cirone, Croydon, PA (US)

( * ) Notice: Subject to any disclaimer, the term of this patent is extended or adjusted under 35 U.S.C. 154(b) by 1043 days.

(21) Appl. No.: 13/278,145

(22) Filed: Oct. 20, 2011

(51) Int. Cl.
*B66B 5/22* (2006.01)
*B66B 5/26* (2006.01)

(52) U.S. Cl.
CPC . *B66B 5/22* (2013.01); *B66B 5/26* (2013.01)

(58) Field of Classification Search
CPC ..... B66B 5/16; B66B 5/22; B66B 5/26
USPC ..... 187/351, 356, 359–365, 372; 49/322; 198/832.2, 323; 188/77 R, 82.7, 300, 343
See application file for complete search history.

(56) References Cited

U.S. PATENT DOCUMENTS 297,459 A * 4/1884 Simmons ..... 187/364
615,362 A * 12/1898 Oliver ..... 187/363
859,718 A * 7/1907 Abbott ..... 187/372
956,552 A * 5/1910 Walker ..... 187/365
962,991 A * 6/1910 Taylor ..... 187/364
1,026,159 A * 5/1912 Gyorffy ..... 187/363
1,151,854 A * 8/1915 Bartos ..... 187/365
1,390,111 A * 9/1921 Fettinger ..... 187/364
4,696,375 A * 9/1987 Matthews et al. ..... 187/313
4,745,726 A * 5/1988 Rosenthal et al. ..... 53/77
4,854,077 A * 8/1989 Rogers et al. ..... 49/322
6,279,268 B1 8/2001 Beaudoin et al.
7,000,354 B2 2/2006 Beaudoin et al.
7,097,003 B2 * 8/2006 Reynolds et al. ..... 187/351

* cited by examiner

*Primary Examiner* — Minh Truong
(74) *Attorney, Agent, or Firm* — LaMorte & Associates P.C.

(57) ABSTRACT

A linear actuator assembly having a flexible tether that runs along a guide track. The flexible tether has a first segment and a second segment, wherein a predetermined tension exists in the flexible tether. A restraining mechanism is coupled to the flexible tether that automatically engages the guide track when the tension in the flexible tether drops below a predetermined threshold. Accordingly, if the flexible tether were to break, the load carried by the linear actuator would lock in place and would not fall under the force of its weight.

15 Claims, 4 Drawing Sheets

FALL ARRESTING SYSTEM FOR VERTICALLY ORIENTED BELT DRIVEN LINEAR ACTUATORS

BACKGROUND OF THE INVENTION

1. Field of the Invention

In general, the present invention relates to devices that prevent a load from falling if a lifting rope, cable, chain, or belt were to unexpectedly break. More particularly, the present invention relates to devices that automatically jam into position if the tension of a lifting rope, cable, chain or belt were to suddenly slacken.

2. Prior Art Description

In the prior art, there are many mechanisms that raise and lower objects using a flexible tether, such as a rope, chain, cable or belt. For example, elevators are typically raised and lowered by cables. Rolling doors are raised and lowered by chains. To prevent injury, such mechanisms often include tether restraint systems that prevent an object from falling should the tether snap. Many such restraint systems are triggered by changes in inertial forces. If an elevator descends too quickly, the restraint system mechanically activates and applies brakes to stop the elevator from falling further.

Restraint systems that are triggered by descent speed or changes in inertia work well for large heavy objects, such as elevators and rolling doors. However, such systems have limitations when scaled down to smaller, lighter systems. For smaller systems, a locking mechanism is often triggered by a detected loss in tension within the supporting tether. Such prior art systems are exemplified by U.S. Pat. No. 7,000,354 to Beaudoin, entitled Cable Failure Device For Garage Doors And The Like And Door including Same; and U.S. Pat. No. 6,279,268 to Beaudoin, entitled Cable Failure Device For Garage Doors And The Like.

Although such prior art restraint systems are effective, they embody a significant lag time between the moment the tether breaks and the moment a supported object is stopped by the restraint system. As a result, the supported object may fall one or two seconds before it is stopped. Such a back-fall is not critical for objects such as garage doors. However, such a back-fall can be disastrous in certain applications, such as factory equipment.

Many types of businesses and factories use electro-mechanical linear actuators to move objects from point to point. For example, in a factory, parts are commonly fed to assembly machines using linear actuators. Likewise, finished goods are often fed into packaging machinery using linear actuators. Such linear actuators are often required to move an object a very precise distance. This is especially true for automated equipment. In such applications, belt driven electro-mechanical linear actuators are often used. Belt driven linear actuators use a belt that is driven by a precision stepper motor. The belt is toothed and engages the gearbox run by the stepper motor or servo motor. As a result, the belt can be driven with a very high degree of accuracy by operating the motor with a computer based controller.

Often belt driven linear actuators move objects horizontally from one place to another. If the belt drive were ever to snap, the object would simply stop moving. However, if the belt driven linear actuator were vertically oriented and the belt were to snap, the object being moved would fall to the lowest point in the actuator under the force of its own weight. This could cause injury to workers or could break or jam very important and expensive factory equipment.

Due to the design of belt driven linear actuators, imprecise restraint systems designed for door cables and other such systems cannot be used. Belt drive mechanical actuators simply lack the room and the tether slack required for such prior art systems to be applied. Furthermore, the back-fall of such prior art systems is far too great for many of the precise applications in which belt driven linear actuators are used.

A need therefore exists for a restraint system that can be applied to the belt drive of a vertically oriented belt driven linear actuator that would prevent an object from falling or moving significantly, should the belt drive snap. This need has been met by the present invention as described and claimed below.

SUMMARY OF THE INVENTION

The present invention is a restraining system for a linear actuator and the new overall assembly of the linear actuator with the restraining system. The linear actuator uses a belt under tension and a guide track to move a lift through a predetermined range. The restraint system locks the lift in a set position relative to the guide track should the belt break. The restraint system includes a support structure that is coupled to the lift. The support structure has a first stop, a second stop, and a gap space that exists between the first stop and the second stop. A sliding wedge is provided that is positioned in the gap space between the first stop and the second stop. The support structure is interconnected to a first segment of the belt and the sliding wedge is interconnected to a second segment of the belt. Accordingly, the tension in the belt biases the sliding wedge toward the first stop.

At least one spring is disposed between the sliding wedge and the first stop. The spring biases the sliding wedge toward the second stop. A locking element is disposed between the sliding wedge and the second stop. When the belt breaks, the spring automatically moves the sliding wedge toward the second stop. This causes the locking element to move up the sliding wedge and extend out of the gap space. At this point, the locking element engages the guide track or a brake belt or rack supported by the guide track and locks the support track into a set position along the guide track.

The restraining system can be easily added to existing linear actuators with low labor and equipment costs.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention restraint system can be applied to many vertical lift machines that use a flexible tether, such as a cable or chain, the present invention restraint system is particularly well suited for use with belt drive lift systems. The embodiments illustrated show the system being used on belt driven linear actuators that are vertically oriented. These embodiments are selected in order to set forth the best mode contemplated for the invention. The illustrated embodiments, however, are merely exemplary and should not be considered a limitation when interpreting the scope of the appended claims.

Figure 1:
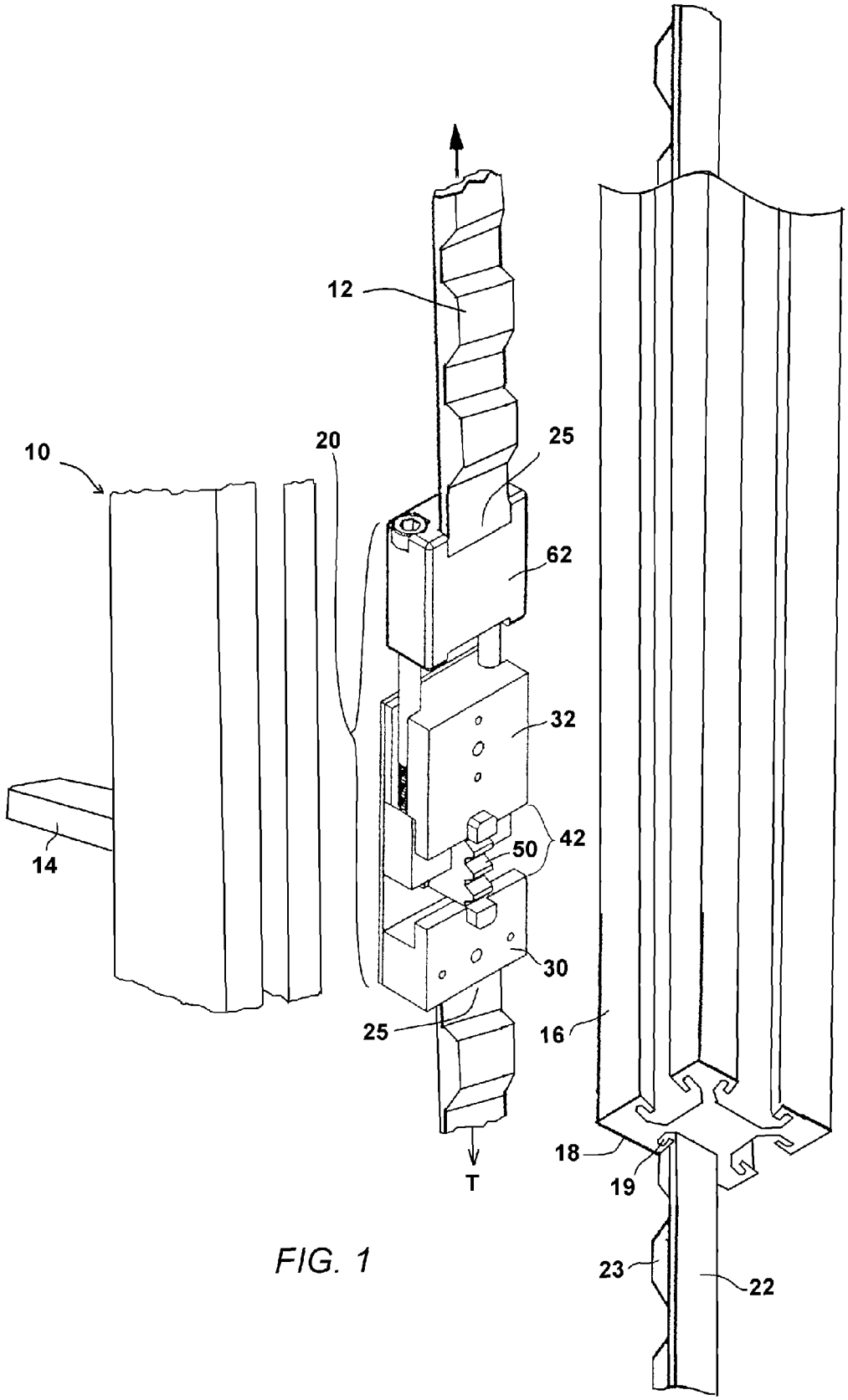
FIG. 1 is a fragmented perspective view of a segment of an exemplary linear actuator containing an a restraining mechanism.

Referring to FIG. 1, a fragmented segment of a vertically oriented electro-mechanical linear actuator 10 is illustrated. The linear actuator 10 has a lift 14 that rides along at least one guide track 16 and reciprocally moves up and down relative to that guide track 16. The relative reciprocal movement of the guide track 16 is created by a flexible primary belt 12. The primary belt 12 travels up and down in front of the guide track 16 through a predetermined range. The purpose of the belt's movement is to move the lift 14 through that predetermined range. The lift 14 can have most any shape. The lift 14 attaches to an object, such as a storage bin, a parts holder or the like. Accordingly, when the belt 12 moves the lift 14, the object also moves.

The primary belt 12 is driven by a traditional drive motor (not shown) that is part of a computer controlled drive system. The primary belt 12 is set at a predetermined tension T. The tension T in the primary belt 12 increases as the lift 14 elevates any object having weight.

The guide track 16 is slotted. The guide track 16 has a face slot 19 on the face surface 18 of the guide track 16. The primary belt 12 travels along the face surface 18 of the guide track 16 in front of the face slot 19. A segment of a brake belt 22 is provided. The brake belt 22 has tooth protrusions 23 on one side. The brake belt 22 is sized to pass into the face slot 19 of the guide track 16. Once paced within the face slot 19, the tooth protrusions 23 of the brake belt 22 face outwardly toward the primary belt 12.

Figure 2:
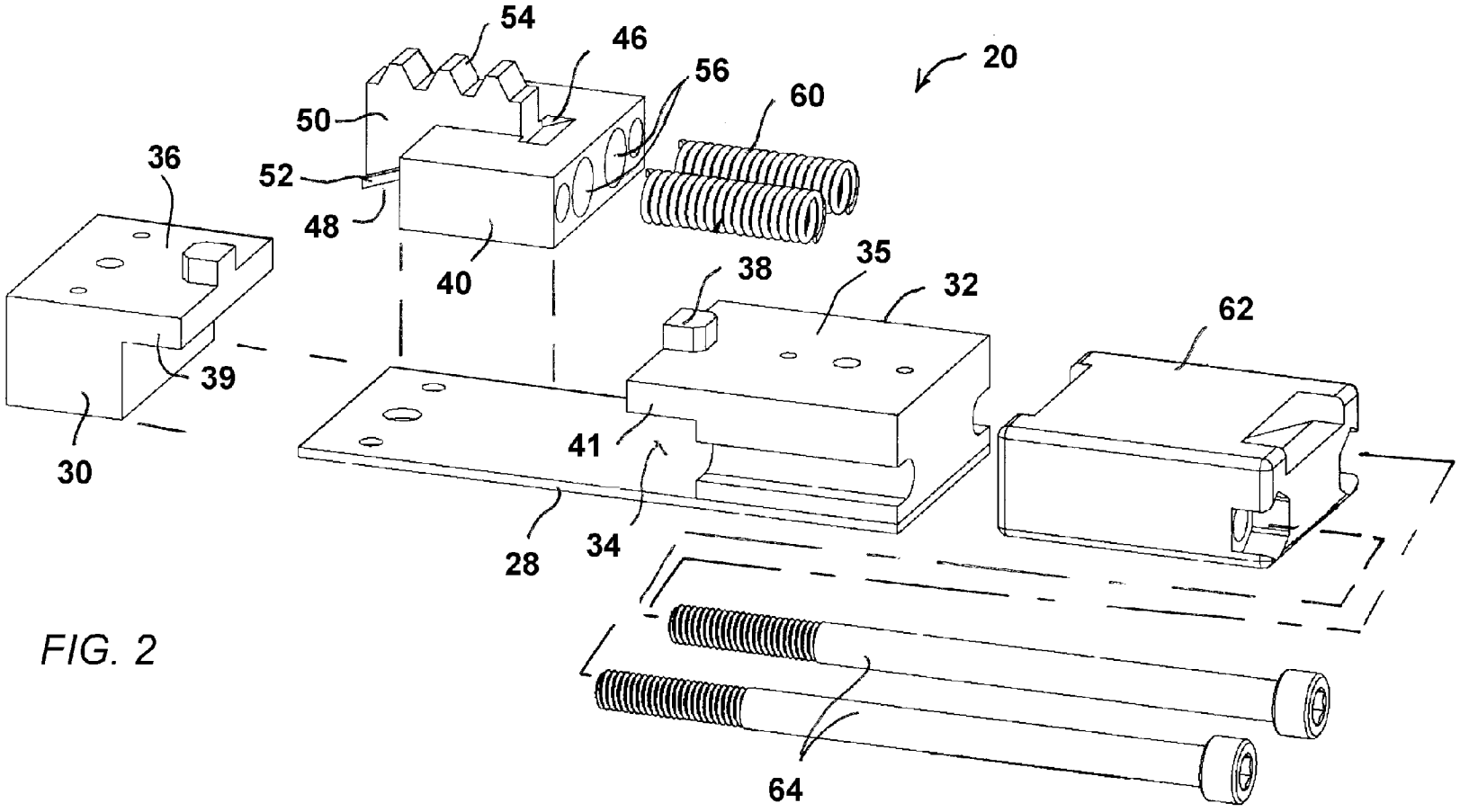
FIG. 2 is an exploded view of the restraining mechanism shown in FIG. 1.
Figure 3:
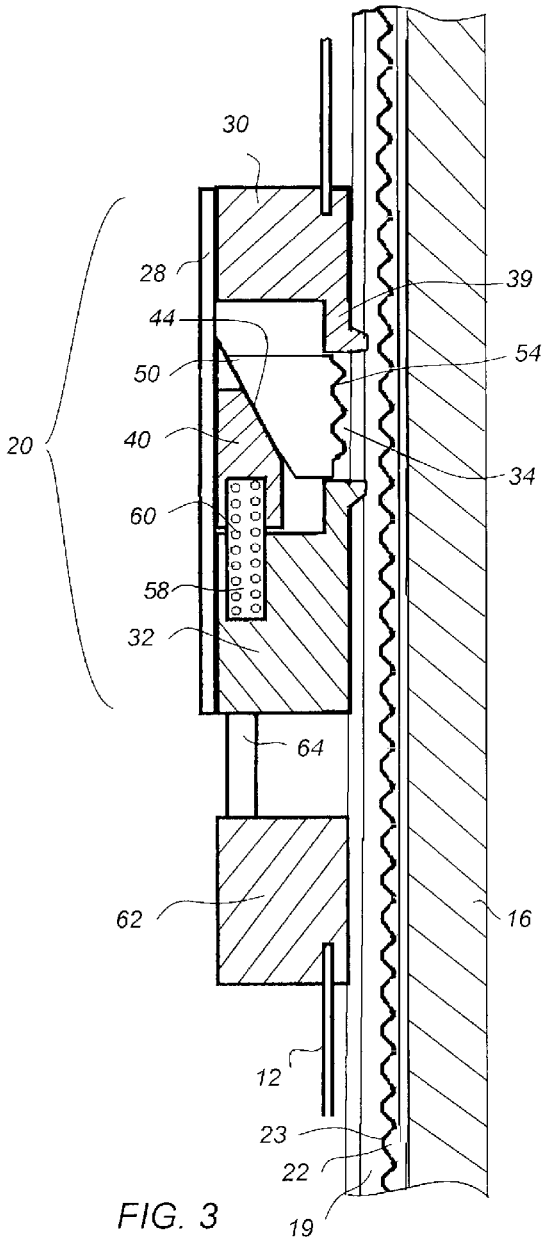
FIG. 3 is a cross-sectional view of the restraining mechanism of FIG. 1 shown in a free configuration with an intact belt.

A restraining mechanism 20 interconnects the lift 14 to the primary belt 12 and moves within the primary belt 12. Referring to FIG. 2 and FIG. 3 in conjunction with FIG. 1, it can be seen that the restraining mechanism 20 is attached in-line with the primary belt 12. The primary belt 12 is cut and the two free ends 25, 26 of the primary belt 12 are attached to the restraining mechanism 20. In this manner, it will be understood that the structure of the restraining mechanism 20 experiences the same tension T as does the primary belt 12.

The restraining device 20 includes a rigid back plate 28. A top stop 32 and a bottom stop 30 are mounted to the back plate 28. The back plate 28, the top stop 32 and the bottom stop 30 create a support structure that mechanically interconnects with the lift 14 and couples the lift 14 to the primary belt 12. One end 25 of the primary belt 12 is anchored to the bottom stop 30. The top stop 32 and the bottom stop 30 are spaced a predetermined distance apart. Accordingly, a gap space 34 exists along the back plate 28 between the top stop 32 and the bottom stop 30. Guide projections 38 are present in the top surfaces 35, 36 of both the top stop 32 and the bottom stop 30. The guide projections 38 help protect the locking mechanism when engaged, as will later be explained.

The top stop 32 has a projecting top ledge 41. Likewise, the bottom stop 30 has a projecting top ledge 39. The presence of the ledges 39, 41 cause the gap space 34 to have a wide bottom and a smaller top opening 42.

A sliding wedge 40 is positioned in the gap space 34. The sliding wedge 40 has a length that is smaller than the wide bottom of the gap space 34 but larger than the narrow top opening 42 of the gap space 34. As a consequence, the sliding wedge 40 can reciprocally move within the gap space 34 but the sliding wedge 40 is too large to pass out of the gap space 34 through the top opening 42.

The sliding wedge 40 presents an inclined surface 44. Guides 46 are formed along the inclined surface 44. A locking element 50 is provided. The locking element 50 has a sloped lower surface 48. Flanges 52 extend from the sides of the sloped lower surface 48 that engage the guides 46 along the inclined surface 44 of the sliding wedge 40. The interconnection between the locking element 50 and the inclined surface 44 enable the locking element 50 to slide up and down along the inclined surface 44 without separating from the inclined surface 44.

Teeth 54 are formed on the top surface of the locking element 50. The teeth 54 terminate in a plane that is parallel to the back plate 28. The teeth 54 remain in this orientation even as the locking element 50 slides up and down the inclined surface 44 of the sliding wedge 40. The locking element 50 has a length that enables the locking element 50 to extend out of the top opening 42 of the gap space 34 when at its highest point upon the inclined surface 44.

The sliding wedge 40 contains blind bores 56. Likewise, the top stop 32 contains blind bores 58. Springs 60 are provided that seat in both sets of blind bores 56, 58. The springs 60 bias the sliding wedge 40 rearwardly within the gap space 34 toward the bottom stop 30.

The sliding wedge 40 is bolted to a connector block 62 using long screws 64. The long screws 64 extend past the top stop 32 without engaging the top stop 32. Consequently, as the sliding wedge 40 moves back and forth within the gap space 34, the connector block 62 also moves back and forth. The movement of the sliding wedge 40 and connector block 62 is relative to the back plate 28, the top stop 32 and the bottom stop 30.

The connector block 62 connects to the drive primary belt 12. Referring to FIG. 3, it will now be understood that a preexisting tension T exists in the primary belt 12. This tension is transferred to the restraining system 20 at the points where the two ends 25, 26 of the primary belt 12 attach. The first end 25 of the primary belt 12 attaches to the bottom stop 30. The bottom stop 30 is anchored to the back plate 28, as is the top stop 32. The opposite second end 26 of the primary belt 12 attaches to the connector block 62. The connector block 62 is anchored to the sliding wedge 40 with the long screws 64. It will therefore be understood that the tension T in the primary belt 12 is pulling the back plate 28, the bottom stop 30, and the top stop 32 in a first direction and is pulling the sliding wedge 40 and the connector block 62 in the opposite direction.

The spring bias force created by the springs 60 acts in opposition of the tension force. The spring constant values associated with the springs 60 are selected so that the preexisting tension force T is greater than the spring bias force. As a result, the springs 60 are compressed by the tension force and the sliding wedge 40 caused to move into contact with the top stop 32. As the sliding wedge 40 moves toward the top stop 32, the ledge 39 of the top stop 32 contacts the locking element 50 and moves the locking element 50 down the inclined surface 44 and into the gap space 34.

Figure 4:
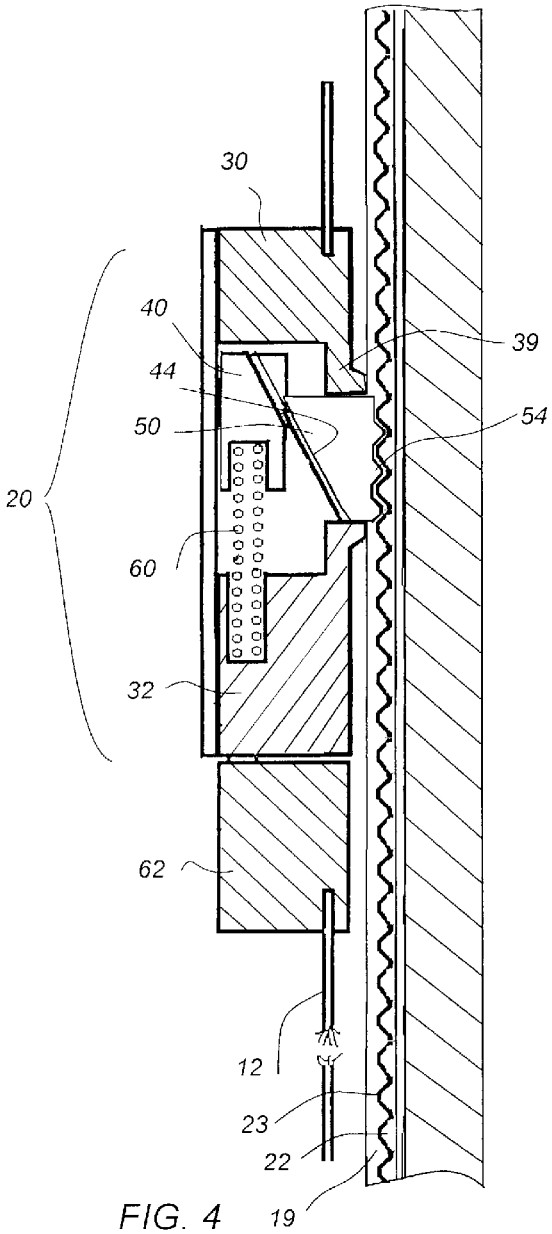
FIG. 4 is a cross-sectional view of the restraining mechanism of FIG. 1 shown in a locked configuration with a broken belt.

Referring now to FIG. 4, and contrasting FIG. 4 with FIG. 3, it can be seen that if the drive primary belt 12 were to snap, the preexisting tension T would instantly disappear. At this movement, the springs 60 would have nothing preventing them from expanding. As the springs 60 expand, they move the sliding wedge 40 in the gap space 34. The sliding wedge 40 is driven toward the bottom stop 30. Before the sliding wedge 40 contacts the bottom stop 30, the locking element 50 contacts the bottom stop 30. This contact drives the locking element 50 up the inclined surface 44 as the sliding wedge 40 advances toward the bottom stop 30. At the moment the sliding wedge 40 contacts the bottom stop 30, the locking element 50 reaches its highest point on the sliding wedge 40.

The guide elements 38 pass into the face slot 19 and ensure that the locking element 50 remains aligned with the face slot 50. This prevents the locking element 50 from binding should the load on the lift 14 apply a turning torque to the restraint mechanism 20.

When the locking element 50 is at its highest point on the sliding wedge 40, the locking element 50 protrudes above the height of the top stop 32 and the bottom stop 30. As the locking element 50 protrudes from the restraint mechanism 20, the teeth 54 on the locking element 50 engages the tooth projections 23 on the brake belt 22 within the face slot 19 of the guide track 16. The teeth 54 on the locking element 50 and the tooth projections 23 on the brake belt intermesh. As a consequence, the restraining mechanism 20 is interconnected with the brake belt 22 and the restraining mechanism 20 can no longer move along the guide track 16 without also moving the brake belt 22 within the guide track 16.

The brake belt 22 can be adhered or riveted into place within the face slot 19 of the guide track 16. If the brake belt 22 is fixed in place, the restraining mechanism 20 will come to an immediate stop as soon as the locking element 50 and the brake belt 22 intermesh. However, the sudden stop can cause wear and or damage to the brake belt 22. In the preferred embodiment, the brake belt is loose within the confines of the face slot 19 of the guide track 16. In this manner, when the locking element 50 intermeshes with the brake belt 22, the brake belt 22 will move slightly with the falling restraining mechanism 20. As the brake belt moves in the face slot 19, the brake belt will begin to compress and buckle within the face slot 19. Since the face slot 19 is not much larger than the brake belt 22, the brake belt 22 quickly binds within the face slot 19. The buckling and the binding of the brake belt 22 in the face slot 19 decelerate the fall of the restraining mechanism 20 and absorbs its kinetic energy. The movement of the restraining mechanism 20 is therefore quickly stopped without any damage or wear to the system components.

It will now be understood that the restraining mechanism 20 moves freely along the guide track 16 with the primary belt 12 for as long as the primary belt 12 remains in tension. The instant the primary belt 12 snaps and the tension force stops, the springs 60 expand, move the sliding wedge 40, and drive the locking element 50 to the top of the inclined surface 44. This makes the locking element 50 protrude into the face slot 19 of the guide track 16. The locking element 50 intermeshes with the brake belt 22. The brake belt 22 binds in the face slot 19 and arrests all movement. This binding action creates a brake mechanism that locks the restraining mechanism 20 into place. Since the restraining mechanism 20 is attached to the lift 14, the lift 14 becomes locked in place. The lift 14 therefore locks in place nearly the instant the primary belt 12 fails.

Once the primary belt 12 fails, the full weight on the lift 14 acts to drive the restraining mechanism 20 down along the guide track 16. However, the teeth 54 of the locking element 50 are now engaged with the brake belt 22 inside the guide track 16. The weight of the lift 14 therefore acts to move the locking element 50 further toward the top stop 32. This causes the locking element 50 to protrude even more and engage the brake belt 22 within the guide track 16 with even greater force. The result is a nearly instantaneous deceleration, where the lift 14 becomes securely locked in place with a minimal of back-fall.

The restraining mechanism 20 is not damaged when activated. To reset the retaining mechanism 20, the primary belt 12 need only be repaired. As soon as tension T is again present in the primary belt 12, the straining mechanism 20 resets and is again ready for use should the primary belt 12 break again.

In the embodiment of FIGS. 1-4 the locking element 50 from the restraining mechanism 20 engages a brake belt 22 in the guide track 16. This embodiment was preferred because a brake belt can be easily and inexpensively added to existing linear actuators. As such, the present invention system can be retroactively added to existing equipment with little labor and at a low cost. However, for new equipment, specialty guide tracks can be designed that would eliminate the need for a brake belt.

Figure 5:
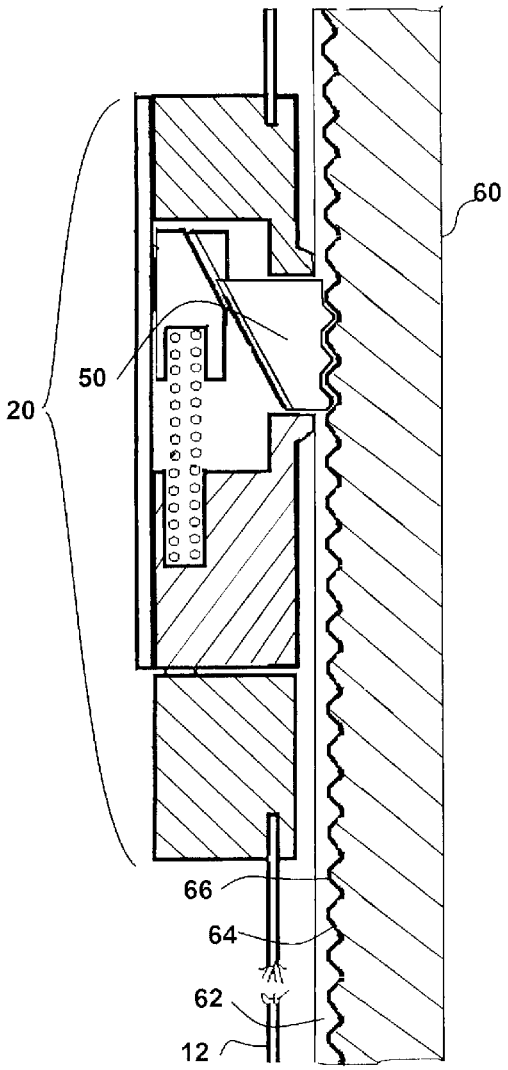
FIG. 5 is a fragment cross-sectional view of a restraining system engaging a variant form of a guide track.

Referring now to FIG. 5, the locking element 50 from the restraining mechanism 20 previously described is shown engaging a different kind of guide track 60. In this guide track 60 there is a face slot 62. No brake belt is present within the face slot 62. Rather, the rear wall 64 of the guide track 60 is roughened by being cold rolled with a pattern 66 during manufacture. The presence of the pattern 66 greatly increases the friction between the locking element 50 and the face slot 62, thereby creating a rapid stop when the restraining mechanism 20 is activated.

Figure 6:
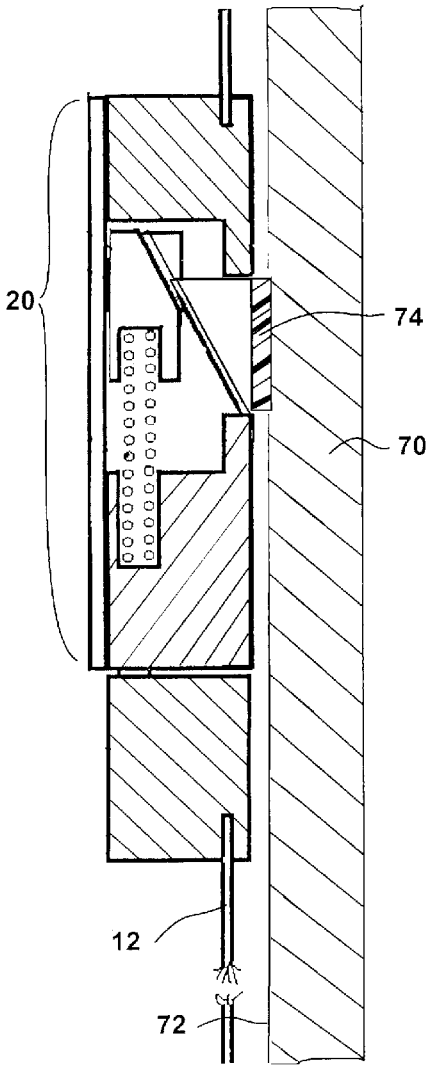
FIG. 6 shows a fragment cross-sectional view of a restraining system variant engaging a second variant form of a guide track.

In many linear actuators, slotted guide tracks are not used. Rather, the linear actuators use tracks with solid surfaces. The present invention restraint system can also be readily adapted to such applications. Referring to FIG. 6, such an application is examined. In this application, the primary belt 12 travels up and down the face surface of a guide track 70. Accordingly, there is no brake belt. Furthermore, the face surface 72 of the guide track 70 is not textured. In this embodiment, the locking element 50 can be provided with rubber stopper 74 instead of teeth. The rubber stopper contacts the guide track when the restraint mechanism 20 is activated.

It will be understood that the embodiments of the present invention that are illustrated and described is merely exemplary and that a person skilled in the art can make many variations to those embodiments. For instance, the shape of the various components can be altered to fit the dimensions and characteristics of most any guide track. Likewise, the lift can have countless configurations depending upon what the linear actuator is designed to lift. All such embodiments are intended to be included within the scope of the present invention as defined by the claims.

What is claimed is:

1. In a linear actuator that utilizes a belt under tension and a guide track to move a lift vertically through a predetermined range, a restraining system for locking said lift in a set position should the belt break, said restraining system comprising:

a support structure coupled to said lift, wherein said support structure has a first stop, a second stop and a gap space that exists between said first stop and said second stop;

a sliding wedge disposed in said gap space between said first stop and said second stop, said sliding wedge having a first inclined surface disposed between side guides, wherein said support structure is interconnected to a first segment of said belt and said sliding wedge is interconnected to a second segment of said belt, wherein said tension in said belt biases said sliding wedge toward said first stop;

at least one spring disposed between said sliding wedge and said first stop that biases said sliding wedge toward said second stop; and a locking element disposed between said sliding wedge and said second stop, said locking element having flanges extending therefrom that engage said side guides of said sliding wedge, therein interconnected said locking element to said sliding wedge and enabling said locking element to reciprocally slide along said first inclined surface without separating from said inclined surface, wherein when said belt breaks, said at least one spring automatically moves said sliding wedge toward said second stop, therein causing said locking element to move along said sliding wedge and extend out of said gap space;

wherein said locking element locks said safety device in a set position along said guide track.

2. The restraining system according to claim 1, further including a brake belt supported by said guide track, wherein said locking element contacts said brake belt when said locking element extends out of said gap space.

3. The restraining system according to claim 1, wherein said locking element has a second inclined surface that contacts said first inclined surface of said sliding wedge as said sliding wedge moves toward said second stop.

4. The restraining system according to claim 1, wherein said locking element has protruding teeth that extend from said gap space as said sliding wedge moves toward said second stop.

5. The restraining system according to claim 1, further including a connector block, wherein said connector block is mechanically connected to said sliding wedge and said second segment of said belt is anchored to said connector block.

6. A linear actuator assembly, comprising:

a guide track having a face surface, wherein a slot is formed within said guide track along said face surface;

a brake belt disposed inside said slot of said guide track;

an actuator belt that runs along said guide track, wherein said actuator belt has a first segment and a second segment, and wherein a predetermined tension exists in said actuator belt;

a lift for moving a secondary object;

a support structure coupled to said lift, wherein said support structure is coupled to said actuator belt and moves with said actuator belt relative said guide track; and a brake mechanism contained within said support structure that automatically extends from said support structure and engages said brake belt within said slot of said guide track to inhibit movement of said support structure relative said guide track when said tension in said actuator belt drops below a predetermined threshold.

7. The assembly according to claim 6, wherein said brake mechanism includes a locking element, and wherein said locking element protrudes from said support structure and engages said brake belt within said guide track when said tension in said actuator belt drops below said predetermined threshold.

8. The assembly according to claim 7, wherein said locking element has protruding teeth that intermesh with protrusions on said brake belt when said locking element contacts said brake belt.

9. The assembly according to claim 8, wherein said brake belt is confined in said slot in said guide track and said brake belt buckles in said slot when engaged and moved by said locking element.

10. The assembly according to claim 6, wherein said support structure includes a first stop, a second stop and a gap space that exists between said first stop and said second stop.

11. The assembly according to claim 10, wherein said brake mechanism includes a sliding wedge that is disposed in said gap space between said first stop and said second stop, wherein said support structure is interconnected to said first segment of said actuator belt and said sliding wedge is interconnected to said second segment of said actuator belt, wherein said tension in said actuator belt biases said sliding wedge toward said first stop.

12. The assembly according to claim 11, wherein said brake mechanism further includes at least one spring disposed between said sliding wedge and said first stop that bias said sliding wedge toward said second stop.

13. A linear actuator assembly, comprising:

a guide track defining an open slot;

a brake belt disposed in said open slot, wherein said brake belt is capable of buckling and binding within said slot when moved within said slot;

a flexible tether that runs along said guide track, wherein said flexible tether has a first segment and a second segment and wherein a predetermined tension exists in said flexible tether; and a restriction mechanism coupled to said flexible tether that automatically engages said brake belt within said open slot of said guide track when said tension in said flexible tether drops below a predetermined threshold, therein causing said brake belt to buckle and bind within said open slot.

14. The assembly according to claim 13, wherein said restriction mechanism includes a locking element that protrudes and engages said brake belt when said tension in said flexible tether drops below said predetermined threshold.

15. The assembly according to claim 14, wherein said locking element and said brake belt both have protrusions that intermesh when said locking element engages said brake belt.

* * * * *